US005781833A

United States Patent [19]

Lewis et al.

[11] Patent Number: 5,781,833

[45] Date of Patent: Jul. 14, 1998

[54] SEALED LIQUID CHARGING APPARATUS

[75] Inventors: Richard B. Lewis, Williamson; Michael J. Levy, Penfield, both of N.Y.

[73] Assignee: Xerox Corporation, Stamford, Conn.

[21] Appl. No.: 566,241

[22] Filed: Dec. 1, 1995

[51] Int. Cl.[6] ..... G03G 15/02

[52] U.S. Cl. ..... 399/168; 361/225; 399/174

[58] Field of Search ..... 355/219, 215; 361/214, 225–228; 430/902; 399/168, 174, 135

[56] References Cited

U.S. PATENT DOCUMENTS

| | | | |
|---|---|---|---|
| 2,904,431 | 9/1959 | Moncrieff-Yeates | 430/97 |
| 2,987,660 | 6/1961 | Walkup | 361/225 |
| 3,394,002 | 7/1968 | Bickmore | 430/48 |
| 3,835,355 | 9/1974 | Tsukada | 361/225 X |
| 3,867,674 | 2/1975 | Simm | 361/225 |
| 4,495,541 | 1/1985 | Magee et al. | 361/225 |
| 5,457,523 | 10/1995 | Facci et al. | 355/219 |
| 5,602,626 | 2/1997 | Facci et al. | 399/135 |

FOREIGN PATENT DOCUMENTS

| | | | |
|---|---|---|---|
| 59-61858 | 4/1984 | Japan | G03G 15/02 |
| 04109262 | 4/1992 | Japan | G03G 15/02 |
| 05297683 | 11/1993 | Japan | G03G 15/02 |

OTHER PUBLICATIONS

U.S. application Ser. No. 08/497,987, filed Jul. 3, 1995, entitled "Ionically Conductive Liquid Charging Apparatus" assignee: Facci et al.

*Primary Examiner*—Arthur T. Grimley

*Assistant Examiner*—Sophia S. Chen

*Attorney, Agent, or Firm*—Denis A. Robitaille

[57] ABSTRACT

An apparatus for applying an electrical charge to a charge retentive surface by transporting ions through an electrically biased ionically conductive liquid and transferring the ions to the member to be charged across the liquid/charge retentive surface interface. The electrically biased ionically conductive liquid medium is brought into contact with the photoreceptor by placing a hydrophilic material imbibed with the ionically conductive liquid in contact with the photoreceptor. The hydrophilic material is partially surrounded by a pair of elongated blade elements as well as a pair of end seal elements for providing a sealed structure for containing the hydrophilic material A voltage is applied to the ionically conductive liquid medium while translating or rotating the charge retentive surface past the ionically conductive medium, thereby enabling the transfer of ions to the charge retentive surface A support blade may be provided for urging the donor blade into contact with the photoreceptor. In addition, a wiper blade may be provided for removing any residual liquid from the surface of the charge retentive surface as may have been transferred thereto by the ionically conductive liquid. A rubber gasket may also be provided for additional sealing of the charging apparatus.

27 Claims, 3 Drawing Sheets

SEALED LIQUID CHARGING APPARATUS

The present invention relates generally to a charging apparatus for enabling ion transfer via ionic conduction through an ionically conductive liquid, primarily for use in electrostatographic applications, for example, for charging an imaging member such as a photoreceptor or a dielectric charge receptor. More specifically, this invention concerns a liquid charging device having a moisture tight seal for preventing escape of liquid therefrom.

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. This latent image is subsequently developed into a visible image by a process in which a charged developing material is deposited onto the photoconductive surface such that the developing material is attracted to the charged image areas on the photoreceptor. Thereafter, the developing material is transferred from the photoreceptive member to a copy sheet or some other image support substrate to which the image may be permanently affixed for producing a reproduction of the original document. In a final step in the process, the surface of the photoreceptive member is cleaned to remove any residual developing material therefrom in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as discharged area development (DAD), or "write black" systems, as opposed to systems which develop toner on the charged areas, known as charged area development (CAD), or "write white" systems. The subject invention applies to both such systems.

Various devices and apparatus are known for applying a uniform electrostatic charge or charge potential to a photoconductive surface prior to the formation of the latent image thereon. Typically, a well-known corona generating type device is utilized for applying charge to the photoreceptor, wherein a suspended electrode including one or more fine conductive electrodes is biased at a high voltage potential, causing ionization of surrounding air which, in turn, results in the deposit of an electrical charge on an adjacent surface, namely the photoreceptor. In addition to charging the photoreceptor of an electrostatographic system prior to exposure, a corona generating devices of the type described, a so-called corotron, can be used in the transfer of an electrostatic toner image from a photoreceptor to the copy sheet, in tacking and detacking a copy sheet to/or from the photoreceptor by neutralizing charge on the sheet, and, generally, in conditioning the photoconductive imaging surface of the photoreceptor prior to, during, and after the deposition of toner thereon for improving the quality of the xerographic output print. Each of these functions is typically accomplished by a separate and independent corona generating device. Thus, the relatively large number of devices within a single machine necessitates the economical use of such corona generating devices.

Historically, several problems have been associated with corona generating devices. The most notable problem centers around the inability of such corona generating devices to provide a uniform charge density along the entire length of the corona generating electrode, resulting in a corresponding variation in the magnitude of charge deposited on associated portions of the adjacent surface being charged. Other problems include the use of very high voltages (6000–8000 V) requiring the use of special insulation, low charging efficiency, arcing caused by non-uniformities between the corotron electrode (coronode) and the surface being charged, vibration and sagging of coronode wires, and, in general, inconsistent charging performance due to the effects of humidity and airborne chemical contaminants on and around the corona generating device. More importantly, corotron devices generate ozone, resulting in well-documented health and environmental hazards. Corona charging devices also generate oxides of nitrogen which eventually desorb from the corotron, causing oxidation of various machine components which may result in an adverse effect on the quality of the final output print.

Various approaches an solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. More specifically, that patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; 3,043,684 to Mayer; 3,398,336 to Martel et al., have been disclosed and discussed in numerous articles of technical literature.

The present invention relates to a device for charging photoconductive imaging member via ionic conduction through a fluid or liquid media such as water, where corona generating devices and other known devices for inducing a charge on an adjacent surface, together with their known disadvantages, can be avoided. In particular, the present invention is directed toward a sealed liquid charging apparatus, wherein the escape of the ionically conductive liquid can be controlled to prevent loss thereof. The following disclosures may be relevant to various aspects of the present invention:

- U.S. Pat. No. 2,904,431 Patentee: Moncrieff-Yeates Issued: Sep.15, 1959
- U.S. Pat. No. 2,987,660 Patentee: Walkup Issued: Jun. 6, 1961
- U.S. Pat. No. 3,394,002 Patentee: Bickmore Issued: Jul. 23, 1968
- U.S. Pat. No. 5,457,523 Patentee: Facci et al. Issued: Oct.10, 1995
- Japanese Patent Application Document No.: 59-61858 Inventor: Itaya Publication Date: Apr. 9, 1984

Japanese Patent Application Document No.: 04-109262 Inventor: Haneda Publication Date: Apr. 10, 1992

Japanese Patent Application Document No.: 05-297683 Inventor: Miyaki Publication Date: Nov. 12, 1993

U.S. Pat. application Ser. No.: 08/497,987 now U.S. Pat. No. 5,602,626 Inventor: Facci et al. Filing Date: Jul. 3, 1995

U.S. Pat. application Ser. No.: 5,561,505 Inventor: Lewis Filing Date: Oct. 3, 1995

The relevant portions of the foregoing disclosures may be briefly summarized as follows:

U.S. Pat. No. 2,904,431 discloses a method and apparatus for providing electrical connection to a body of semiconductive or dielectric material, wherein the method comprises closely spacing the surface of an electrode from the surface of the body to which connection is to be made with a film forming liquid. When a voltage is applied to the electrode, an electric field is generated across the liquid film, causing the liquid to behave as a conductor transversely through the layer while continuing to behave as an insulator in the lateral direction. That patent includes a method of electrically charging the surface of a body of semiconductive or dielectric material.

U.S. Pat. No. 2,987,660 discloses a xerographic charging process for applying an electric charge to the surface of an insulating or photoconductive insulating layer by electrification with a conductive or electrolytic liquid wherein the charge applied is of substantially the same potential as the potential on the contacting liquid and is substantially uniform across the entire area being charged.

U.S. Pat. No. 3,394,002 discloses a method of applying charge onto an electrically insulating surface utilizing a liquid of high resistivity across which an electrostatic image is transferred. More particularly, that patent relates to the chemical doping of liquid materials utilized in various electrostatic imaging systems whereby the electrical charge transfer characteristics thereof are controlled for effecting image charge transfer between juxtaposed surfaces of different imaging materials.

U.S. Pat. No. 5,457,523discloses a device for applying an electrical charge to a charge retentive surface by transporting ions in a fluid media and transferring the ions to the member to be charged. The fluid media is a ferrofluid material wherein a magnet is utilized to control the position of the fluid media, which in turn can be utilized to selectively control the activation of the charging process.

Japanese Patent Application Document No. 59-61858 discloses a charging/discharging device comprising ferromagnetic metal fluid retained in a magnetic field formed by a magnetic field generation means. The features of the structure described in that publication are attained by bringing ferromagnetic metal fluid into direct contact with the surface of an insulator to be charged or discharged, whereby the ferromagnetic fluid is maintained at an electrode section through magnetism for contacting the insulator to be charged or discharged. Magnetic bodies are mounted on both sides of a rotatable magnet, whereby the magnet is rotated for selectively contacting the fluid media with the member to be charged.

Japanese Patent Application Document No. 04-109262 discloses a charging device which restrains magnetic fluid via magnetic force, wherein a magnetic fluid is interposed between a pair of conducting magnets. The structure disclosed in that publication is described as having a magnet positioned on the left and right with a retaining unit positioned at the rear to form a support frame for magnetic fluid, whereby the magnetic fluid is supported and restrained by the magnetism of the magnets positioned on the left and right.

Japanese Patent Application Document No. 05-297683 discloses a charging device comprising a liquid high resistance charging electrode, whereby a receptacle is filled with a liquid charging electrode and a high voltage power source is connected to the liquid electrode in order to complete a structure in which corona discharge develops between the liquid charging electrode and a photoreceptive drum.

U.S. Pat. application Ser. No. 08/497,987, now U.S. Pat. No. 5,602,626, discloses an apparatus for applying an electrical charge to a charge retentive surface by transporting ions through an ionically conductive liquid and transferring the ions to the member to be charged across the interface between the liquid and the charge retentive surface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment disclosed therein, the charging apparatus includes a support blade for urging the donor blade into contact with the charge retentive surface and a wiping blade for wiping any liquid from the surface of the charge retentive surface as may have been transferred from the donor blade to the charge retentive surface interface.

U.S. Pat. No. 5,561,505 discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted retractable donor blade supported within a mechanically sealable housing adapted to permit movement of the wetted donor blade from an operative position in contact with the charge retentive surface, to a nonoperative position stored within the housing to prevent loss of the ionically conductive liquid in its liquid or vapor form so as to extend the functional life of the apparatus. In one specific embodiment, a retractable wiper blade is also provided for removing any liquid droplets from the surface of the photoreceptor as may have been transferred at the donor blade/charge retentive surface interface.

In accordance with the present invention, a liquid charging apparatus for applying an electrical charge to a member to be charged is provided, comprising: a donor member positioned in contact with the member to be charged for placing an ionically conductive liquid in contact therewith, the donor member including a hydrophilic material layer containing the ionically conductive liquid; a pair of nonporous blade elements, each situated on either side of said hydrophilic material layer for preventing escape of the ionically conductive liquid along elongated sides of the donor member; and a pair of hydrophobic end segments each situated at opposite ends of the pair of nonporous blade elements for preventing escape of the ionically conductive liquid from the hydrophilic material layer along opposed ends of the donor member; and means for applying an electrical bias to the ionically conductive liquid for inducing transport of ions therethrough to the member to be charged In accordance with another aspect of the invention, an electrostatographic printing machine including a liquid charging apparatus for applying an electrical charge to a photoreceptive member is provided, comprising: a donor member positioned in contact with the member to be charged for placing an ionically conductive liquid in contact therewith, the donor member including a hydrophilic material layer containing the ionically conductive liquid; a pair of nonporous blade elements, each situated on either side of said hydrophilic material layer for preventing escape of the ionically conductive liquid along elongated sides of the donor member; and a pair of hydrophobic end segments each situated at opposite ends of the pair of nonporous blade elements for preventing escape of the ionically conductive liquid from the hydrophilic material layer along opposed ends of the donor member; and means for applying an electrical bias to the ionically conductive liquid for inducing transport of ions therethrough to the member to be charged.

These and other aspects of the present invention will become apparent from the following description in conjunction with the accompanying drawings in which.

Figure 1:
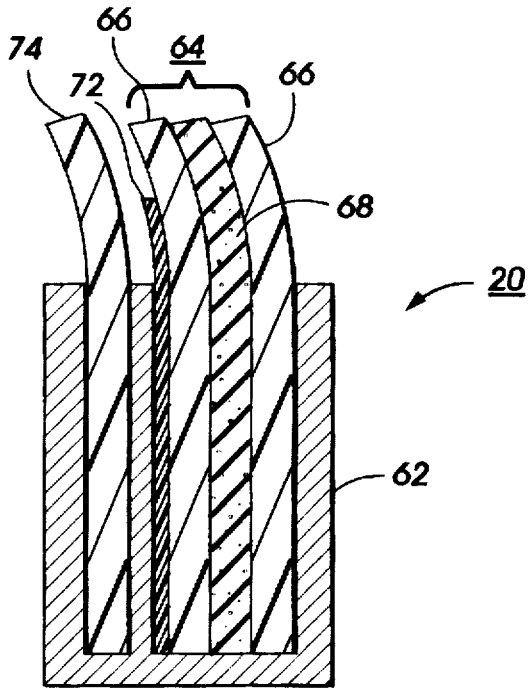
FIG. 1 is a simple cross sectional side view of a sealed ionically conductive liquid charging apparatus in accordance with the present invention.

For a general understanding of the features of the present invention, reference is made to the drawings wherein like reference numerals have been used throughout to designate identical elements. While the present invention will be described in connection with a preferred embodiment thereof, it will be understood that the invention is not limited to this preferred embodiment. On the contrary, the present invention is intended to cover all alternatives, modifications, and equivalents as may be included within the spirit and scope of the invention as defined by the appended claims.

Figure 3:
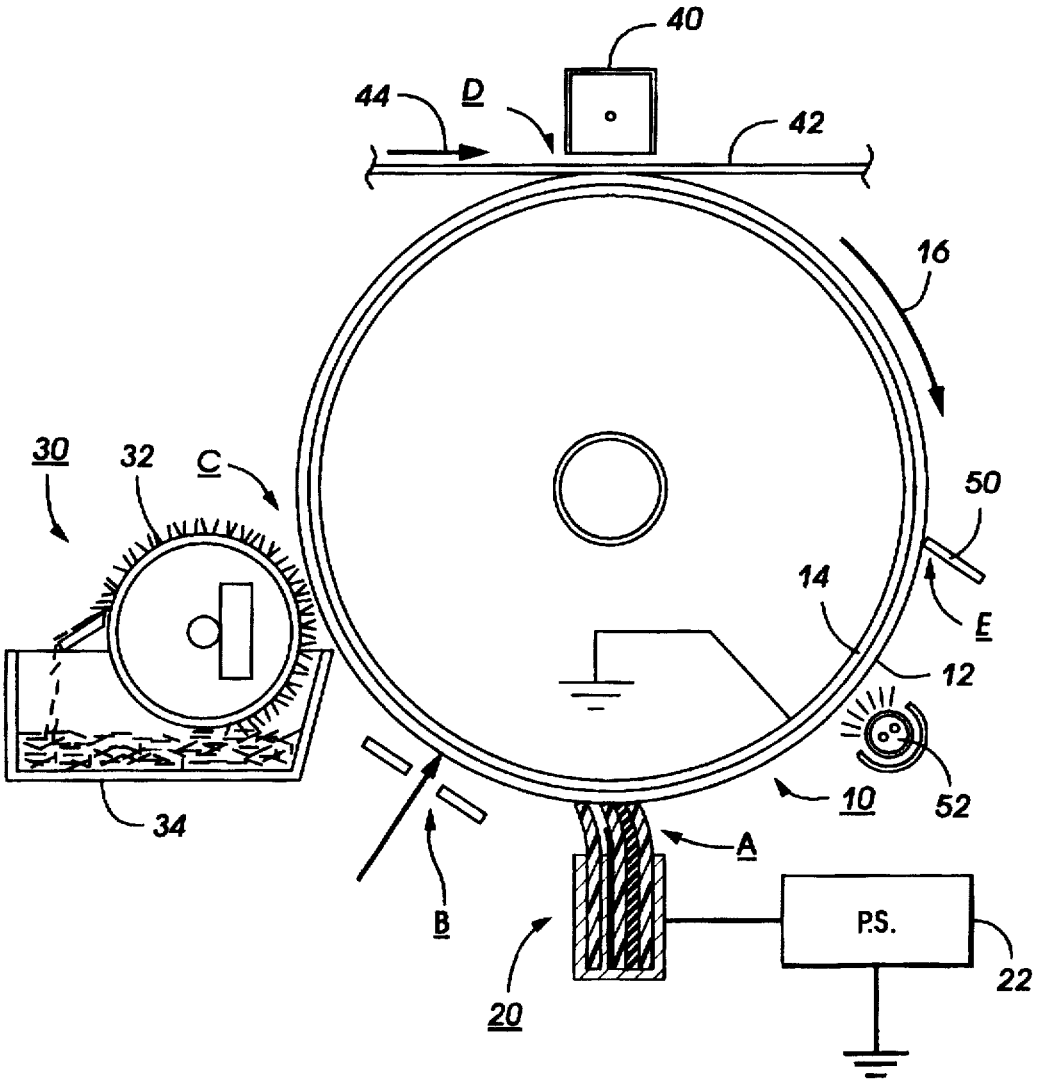
FIG. 3 is a schematic elevational view showing an electrostatographic copier employing the sealed ionically conductive liquid charging apparatus of the present invention.

Referring initially to FIG. 3 prior to describing the invention in detail, a schematic depiction of the various components of an exemplary electrostatographic reproducing apparatus incorporating the ionically conductive liquid charging apparatus of the present invention is provided. Although the apparatus of the present invention is particularly well adapted for use in an automatic electrostatographic reproducing machine, it will be understood that the instant charging structure is equally well suited for use in a wide variety of electrostatographic-type processing machines and is not necessarily limited in its application to the particular embodiment or embodiments shown herein.

The exemplary electrostatographic reproducing apparatus of FIG. 3 employs a drum photoreceptor 10 including a photoconductive surface 12 deposited on an electrically grounded conductive substrate 14. A motor (not shown) engages the drum 10 for rotating the photoreceptor 10 in the direction of arrow 16, thereby advancing successive portions of photoconductive surface 12 through various processing stations disposed about the path of movement thereof, as will be described.

Initially, a portion of the photoconductive surface 12 passes through a charging station, generally identified by reference letter A, where a charging device, indicated generally by reference numeral 20, charges the photoconductive surface 12 to a relatively high, substantially uniform potential. In general, the charging device 20 in accordance with the present invention comprises an apparatus adapted to contact a liquid compound or fluid material to the surface of drum 10, wherein a voltage is applied across the liquid as drum 10 rotates, thereby enabling the transfer of ions across the interface between the liquid compound and the photoreceptor surface. The photoconductive surface 12 thus becomes electrically charged by the transport of ions through the liquid, in contrast to the application of a charge via a corotron or other corona generating device. A detailed description of a charging device in accordance with the present invention will be provided following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document. One skilled in the art will appreciate that various methods may be utilized to irradiate the charged portion of the photoconductive surface 12 for recording the latent image thereon as, for example, a properly modulated scanning beam of energy (e.g., a laser beam).

After the electrostatic latent image is recorded on the photoconductive surface 12 of drum 10 the drum is advanced to development station C where a development system, such as a magnetic brush developer, indicated generally by the reference numeral 30, deposits developing material onto the electrostatic latent image to create a developed image. The exemplary magnetic brush development system 30 shown in FIG. 3 includes a single developer roller 32 disposed in a developer housing 34, in which toner particles are mixed with carrier beads to create an electrostatic charge therebetween, causing the toner particles to cling to the carrier beads to form the developing material. The developer roller 32 rotates to form a magnetic brush having the developing material magnetically attached thereto. As the magnetic brush rotates, the developing material is brought into contact with the photoconductive surface 12 such that the latent image thereon attracts the toner particles of the developing material to form a developed toner image on photoconductive surface 12. It will be understood by those of skill in the art that numerous types of development systems could be substituted for the magnetic brush development system shown and described herein.

After the toner particles have been deposited onto the electrostatic latent image for development thereof, drum 10 advances to transfer station D, where a sheet of support material 42 is transported in a timed sequence into contact with the developed toner image so that the developed image on the photoconductive surface 12 contacts a advancing sheet of support material 42 at transfer station D. A charging device 40 is provided for creating an electrostatic charge on the backside of support material 42 to aid in inducing the transfer of toner from the developed image on photoconductive surface 12 to the support material 42. While a conventional coronode device is shown to represent charge generating device 40, it will be understood that various charging devices, including the ionically conductive liquid charging device of the present invention, might be substituted for the corona generating device 40 for providing the electrostatic charge which induces toner transfer to the support material 42. However, it will be recognized that the use of a liquid charging device at the transfer station may produce undesirable effects due to the contact of liquid to the support material such that the use thereof may not be practical. After image transfer, the support material 42 is subsequently transported in the direction of arrow 44 for placement onto a conveyor (not shown) which advances the sheet to a fusing station (also not shown) for permanently affixing the transferred image to the support material 42 for subsequent removal of the finished copy or print.

Often, after the support material 42 is separated from the photoconductive surface 12 of drum 10, some residual developing material remains in contact with to the photoconductive surface 12. Thus, a final processing station, namely cleaning station E, is provided for removing residual toner particles from photoconductive surface 12 subsequent to separation of the support material 42 from drum 10 in preparation for a subsequent imaging cycle. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp 52 for flooding the photoconductive surface 12 with light in order to dissipate any residual electrostatic charge remaining thereon.

The foregoing description should be sufficient for purposes of description to illustrate the general operation of an electrostatographic reproducing apparatus incorporating the features of the present invention. As described, an electrostatographic reproducing apparatus may take the form of any of several well known systems. Variations of the specific electrostatographic processing subsystems or processes described herein may be expected without affecting the operation of the present invention. For example, to those skilled in the art, the photoconductive coating of the photoreceptor may be placed on a flexible belt of either seamed or unseamed construction, continuous or not, without affecting the operation of the present invention. However, it will be recognized that a sufficiently rough seam may disturb or damage the sealing or charging members of the sealed liquid charging apparatus.

Referring now, more particularly, to ionically conductive liquid charging devices to which the specific subject matter of the present invention is directed, an exemplary ionically conductive liquid charging apparatus 20 will be described in greater detail. By way of background, an ionically conductive liquid apparatus operates by enabling ionic conduction charging of a photoconductive imaging member, or any dielectric member placed in contact therewith, whereby an ionically conductive liquid having a voltage applied thereto is placed in contact with the surface of the photoconductive imaging member such that ions are transported through the liquid and transferred to the photoreceptor across the interface between the liquid and the photoconductive surface. The photoreceptor thus becomes charged by the flow of ions through the liquid component rather than by the spraying of ions onto the photoreceptor through a gaseous media as occurs in a corotron or similar corona generating-type device. In simplest terms, the ionically conductive liquid is biased by a voltage approximately equal to the surface potential desired on the photoreceptor, causing ions to be deposited at the point of contact between the ionic liquid and the photoreceptor until the electric field thereacross is completely diminished.

Examples of ionically conductive liquid materials which may serve satisfactorily in the context of an ionically conductive liquid component include any liquid based material capable of conducting ions, including simple tap water and even distilled or deionized water (where the ionic conductivity thereof is believed to be caused by the known dissolution of carbon dioxide in water). Components which can be added to the water to render it more ionically conductive include atmospheric carbon dioxide ($CO_2$), lithium carbonate, sodium carbonate, potassium carbonate, sodium bicarbonate and the like. The concentration ranges can vary from trace levels to saturation. Another example of an ionically conductive medium is a gel that is composed of 96 wt % water and 4 wt % acrylic acid neutralized with NaOH. Other gel materials include gelatin, gums and mucilages both natural and synthetic. Other hydrogels include polyhydroxyethylmethacrylates, polyacrylates, polyvinylpyrrolidinone and the like. Numerous other fluid compounds and materials which may be desirable for use with the apparatus of the present invention are described in commonly assigned U.S. patent application entitled Photoconductive Charging Processes filed on May 27, 1994, identified by U.S patent application Ser. No. 08/250,749.

In an exemplary embodiment disclosed in U.S. Pat. application Ser. No. 08/497,987, the photoreceptor is charged by wetting, with an ionically conductive liquid, an electrically biased foam element and placing this element in contact with the photoreceptor. The electrical bias causes the ions present in the ionically conductive liquid material to separate while rotation or translation of the imaging member causes the ions charge to transfer from the foam to the photoreceptor, creating a charge thereon which is substantially equivalent to the voltage applied from the power source. When a positive voltage is applied from the power source, positive ions migrate toward the photoreceptor and when a negative voltage is applied from the power source negative ions migrate toward the photoreceptor.

The described process is considered highly efficient when two conditions are met. The first is that of insignificant voltage drop in the ionically conductive medium or the donor (e.g. foam). This condition is satisfied for example, in pure distilled water where the IR drop at 20 inches per second is no more than about 25 volts. This represents a waste of about 4 percent of the applied voltage when the applied voltage is 625 volts. The voltage drop across the ionically conductive medium can be reduced and the efficiency increased by increasing the ionic conductivity of the ionically conductive medium, which can be accomplished, for example, by adding a low concentration of an ionic species, for example, about 0.1 mM. The second condition is that the imaging member and the ionically conductive medium remain in contact for a sufficient period of time so that the voltage developed on the imaging member reaches the applied voltage less the IR drop in the ionically conductive medium. The Table that follows illustrates the calculated current expected at various process speeds, assuming an applied voltage of 1,000 volts, a relative dielectric constant of 3.0, an imaging member thickness of 25 microns and a 16 inch long charging mechanism (1,000 $cm^2$/panel).

| PROCESS SPEED | CURRENT | POWER |
|---|---|---|
| 2 ips | 20 uA | 20 mW |
| 10 ips | 100 uA | 100 mW |
| 20 ips | 200 uA | 200 mW |

One advantage of ion transfer across a liquid medium relative to a corona generating type device wherein ions are transferred through an air gap is that ozone production is significantly reduced. Contact ionic charging produces less than 1 percent of the ozone that a corotron produces. For example, a commercial organic photoreceptor drum of diameter 3.2 inches was run at a surface speed of 48 inches per second while being charged repeatedly by an ionically conductive liquid in a process as described hereinabove. Measurements of ozone concentration within one half inch of the charging zone were below the analytical detection limit of 0.005 parts per million. Since organic photoreceptors are usually charged to less than −800 volts, ion transfer charging of the present invention is, for all practical purposes, ozoneless. This eliminates at least one photoreceptor degradation mechanism, that is a print defect commonly known as parking deletions. In addition the need for ozone management and filtration is eliminated, such that ionic charging devices present a lower health hazard than typical corona generating devices.

It is noted that an imaging member cannot be overcharged by the process disclosed in the present invention. The maximum voltage to which the imaging member can be charged is the voltage applied to the liquid media. The charging of the imaging member is limited to this value since the electric field across the bulk of the fluid medium, which drives the ions to the fluid/insulator interface, drops to zero when the voltage on the imaging member reaches the voltage applied to the fluid. Conversely, the imaging member can be undercharged if insufficient time is allowed for contact between the imaging member and the ionically conductive medium. The degree of undercharging is usually not significant (25–50 V) and can be compensated for by the application of a higher voltage to the ionically conductive medium. Moreover, it is noted that despite this voltage drop, the charge on the photoreceptor is uniform. The circumferential rotating speed of the photoreceptor can range from very low values like infinitesimally greater than zero speed to high speeds such as, for example, about 100 inches per second and preferably from zero to about 20 inches per second.

Another advantage of the processes of ionically conductive liquid charging can be found in that the complexity of power supply requirements can be diminished. Since it is no longer necessary to control the discharge of corona, only a DC voltage bias is applied to the fluid media. Thus, the power supply is simpler than typical charging systems which use an AC signal superimposed onto a DC signal. In addition, the voltages necessary to operate the present invention are lower than any other practical charging device.

Yet another advantage to ionically conductive liquid charging is the high degree of charge uniformity provided thereby. It is believed that the potential distribution on the dielectric being charged adjusts itself during the charging process in such a way that undercharged areas tend to become "filled in" with the additional ions, leading to a uniform deposition of ions on the dielectric layer. It has been shown that the variation in surface voltage is essentially at or below the measurement accuracy of plus or minus 1 to 2 volts over a coated Mylar, a polyester film manufactured by E.I. DuPont deNemours and Co., surface. The device has also been shown to be capable of uniformly charging a photoreceptor surface up to 50 inches per second.

Moving now to the specific subject matter of the present invention, the sealed liquid charging apparatus in accordance with the present invention is directed toward the problem of liquid loss, either as a liquid or as a vapor, which poses a serious problem in an ionically conductive liquid charging apparatus of the type described hereinabove. The need for containment of the liquid material whether by minimizing water evaporation or supressing runout of the liquid onto the photoreceptor to prevent liquid loss from the device, especially under conditions in which the electrostatographic printing machine is at rest or in a non-printing state, is essential to maintaining a relatively lengthy life for the device. As a solution to this problem, the ionically conductive liquid charging apparatus of the present invention includes elements configured to permit contact of an ionically conductive liquid material to surface 12 of the photoreceptor 10 while also providing a seal to prevent loss of the liquid from the charging apparatus.

Figure 2:
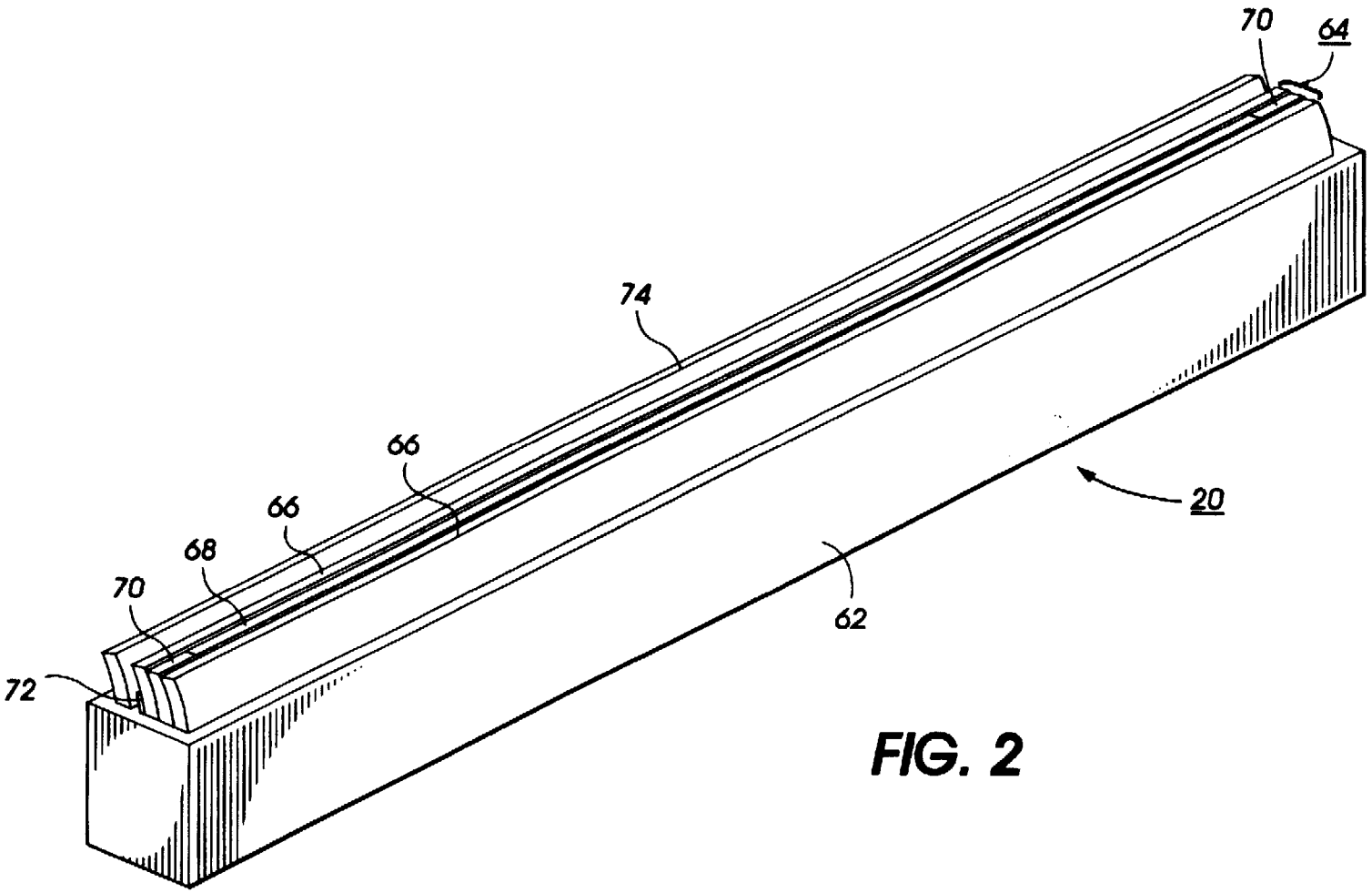
FIG. 2 is a perspective view of the sealed liquid charging apparatus of the present invention.

Referring now to FIGS. 1 and 2, the ionically conductive liquid charging apparatus of the present invention will now be described in detail. As can be seen from the referenced drawings, the liquid charging device 20 includes a multi-element liquid donor member 64 supported within a housing 62. As will be described, the multiple elements of the donor member 64 combine with the housing 62 to create a sealed assembly capable of placing a liquid medium contained therein in contact with a surface (i.e. the photoconductive surface) positioned in abutment with the donor member 64 while providing an effective means for enveloping the liquid to prevent the escape thereof, by either evaporation or liquid release.

Beginning with a description of the housing 62, in addition to providing a support structure for the donor member 64, the housing 62 may also serve as a reservoir for storing an amount of the ionically conductive liquid used by the donor member 64, as well as a structure for coupling the ionically conductive liquid to an electrical power supply such as D.C. power supply 22. As such, the housing 62 is preferably conductive in nature, preferably fabricated from a material which allows conduction of electricity while not being susceptible to oxidation or corrosion upon exposure to the particular ionically conductive liquid utilized in the charging apparatus, such as, for example, brass, stainless steel or other conductive materials including conductive composites such as carbon loaded polymer.

The conductive housing 62 is coupled to a DC voltage power supply 22 for applying an ion transporting bias voltage to the donor member 64, whereby a voltage bias is applied to the ionically conductive liquid material via the electrical connection of the DC power supply 22 coupled to housing 62. Alternatively, electrical contact can also be made to the ionically conductive fluid either by immersing a conductor connected to the power supply 22 into the liquid carried within the donor member 64. Typical voltages provided by the power supply 22 might range from about −4000 V to about +4000 V, and preferably between about ±400 to about ±700. As previously noted, the voltage that is applied to the photoconductive surface 12 is essentially equal to the voltage applied to the ionically conductive liquid such that a voltage of 750 volts, for example, applied to the ionically conductive liquid medium results in a voltage of about 750 volts or slightly less on the photoreceptor. The voltage supplied by the power source 22 can be of a positive or negative polarity, with the polarity of the charge deposited by the donor member 64 being controlled exclusively by the polarity of the supplied voltage. Thus, the application of a positive bias to the ionically conductive liquid material causes positive ions to transfer to the photoreceptive member while the application of a negative bias to the ionically conductive liquid causes negative ions to transfer to the photoreceptive member.

Moving now to a description of the donor member 64, the donor member 64 is comprised of a pair of elongated blade elements 66 situated adjacent one another, having a layer of hydrophilic material 68 interposed therebetween, the layer of hydrophilic material 68 being imbibed with an ionically conductive liquid which may be water. Each blade element 66 is substantially similar, preferably being relatively flexible in nature and fabricated from a nonporous elastomeric polymer or polyurethane material, effectively creating a seal along the elongated sides of the charging apparatus. The elongated blade elements 66 may also be fabricated from a hydrophobic polymer, for example VITON®, a copolymer of vinylidene fluoride/hexafluoropropylene, or terpolymers of vinylidene fluoride/hexafluoropropylene and tetrafluoroethylene. Other hydrophobic polymers which may be utilized for the elongated blade elements 66 include polybutadiene and silicone elastomers. End sealing elements 70 are also provided, situated at the opposite ends of the elongated blade elements 66, and also interposed therebetween, for effectively creating a seal along the ends of the charging apparatus. In a preferred embodiment, end sealing elements 70 are fabricated from a hydrophobic material which is highly resistant to the ionically conductive liquid used to imbibe the hydrophilic material of the charging apparatus for preventing leakage of the liquid contained therein along the end portions of the donor member 64. Thus, the multiple elements of the donor member 64 are configured in such a way as to provide a hydrophilic material layer 68 imbibed with an ionically conductive liquid which is sealed along four sides by elongated blades 66 and end seals 70, while permitting access to the liquid material in the hydrophilic material layer 68 along a surface opposite the housing 62 to allow the liquid to be contacted to an abutting surface.

Although numerous and various hydrophilic and hydrophobic compounds and materials are known in the art and may be utilized to produce a sealed ionically conductive liquid charging device in accordance with the present invention, it has been found that it is very important that, in order to provide a liquid charging device that is substantially failure free, the hydrophilic and hydrophobic compounds and materials utilized therein should possess substantially equivalent mechanical properties. That is, a significant design defect has been recognized in the liquid charging device of the type described while in the operational mode, wherein blade members 66, in particular, the downstream blade member relative to the process direction of the photoconductive surface, may become unseated from the surface of the photoreceptor in the area of interface between the hydrophilic and hydrophobic materials. It is believed that this failure mode is caused by differing reactive forces created between the material layers 68 and 70 when placed in physical contact with the rotating surface 12 of the photoreceptive member 10. This failure mode may result in non-uniform charging of the photoconductive surface as well as the release of undue amounts of the ionically conductive liquid from the charging apparatus.

Thus, the solution presented by the instant invention is to provide the hydrophilic material layer 68 of the charging apparatus with mechanical and physical properties which are substantially equivalent to the mechanical and physical properties of the hydrophobic material making up the end seals 70. To this end, a preferred embodiment of the present invention is defined by a hydrophilic material which is provided in the form of a crosslinked gel such as polyacrylamide or the like, while the hydrophobic material is also provided in the form of a crosslinked gel, such as silicone rubber or the like. It will be recognized by those of skill in the art that a hydrophilic gel material can be formed by binding an ionically conductive liquid into a polymeric gel network such as a crosslinked polyvinyl alcohol. This hydrophilic gel layer is placed between a pair of elastomeric blade elements to create a donor member of the type described hereinabove, having end seals fabricated from, for example, an RTV silicone. In the resultant structure, the forces created by the contact of the donor member 64 and the moving surface of the photoreceptive drum 10 is substantially uniform along the length of the donor member 64 such that the blade members 66 remain substantially in contact with the surface 12 of the photoreceptive drum 10, without becoming unseated therefrom.

As can be seen from FIGS. 1 and 2, it is contemplated that the sealed liquid charging apparatus of the present invention may also include a support member 72, fixed within the housing 62 and situated in abutment with the downstream blade element 66, relative to the direction of travel 16 of the photoreceptive surface 12. The support member 72 is fabricated from a relatively rigid material with respect to the blade elements 66, providing structural rigidity for urging the donor member 64 against the photoreceptor surface 12 in a springloaded manner. It has been found that a thin strip of MYLAR® may provide an effective support member 72, although those of skill in the art will understand that various other materials and structures may be utilized to accomplish the same results.

In addition to the support blade 72, the preferred embodiment shown in FIGS. 1 and 2 may also include a wiper blade 74, provided for removing any small amount of fluid from the surface of the photoreceptor 12, as may have been transferred thereto at the interface between the donor member 64 and the photoreceptor surface 12. Thus, a polyurethane type blade situated downstream from the donor member 64 and support blade 72 relative to the direction of travel 16 of the photoreceptor surface 12 is provided for wiping the surface of the photoreceptive drum 10 and eliminating transfer of water or other liquid thereto. The use of a wiper blade 74 may also advantageously permit a higher concentration of liquid to be applied by the donor member 64. Clearly, the effectiveness of the wiper blade 74 can be enhanced by optimizing such factors as the liquid concentration at the donor member 64/photoreceptor surface 12 interface, as well as the wipe angle and/or the stiffness of the wiper blade 74. The wiper blade 74 may also provide increased operational lifetime to the charging apparatus of the present invention by providing a means for returning the ionically conductive liquid to the donor member 64 or to a reservoir coupled thereto for use in subsequent charging operations. In this regard, the housing 62, shown in FIGS. 1 and 2, which illustrates a central support member situated between the donor member 64 and the wiper blade 74, may include a plurality of openings for allowing liquid to pass from a channel supporting the wiper blade 74 to a channel supporting the donor member 64 . Alternatively, or in addition, a liquid management system (not shown) may be provided for suplying liquid to the housing 62 of the charging apparatus 20 for continually moistening the hydrophilic material layer 68 of the donor member 64.

In review, the present invention is directed to an apparatus for charging photoreceptors by the transfer of ions thereto from an ionically conductive liquid medium, wherein this liquid medium is brought into contact with the photoreceptor by placing a hydrophilic material imbibed with the ionically conductive liquid in contact with the photoreceptor. The hydrophilic material is partially surrounded by a pair of elongated blade elements as well as a pair of end seal elements for providing a sealed structure for containing the hydrophilic material. A voltage is applied to the ionically conductive liquid medium while translating or rotating the photoreceptor past the ionically conductive medium, thereby enabling the transfer of ions to the photoreceptive member. In addition, a conductive housing is provided for contacting the liquid or an element such as a donor blade carrying the liquid to the photoreceptor surface. A support blade may be provided for urging the donor blade into contact with the photoreceptor. In addition, a wiper blade may be provided for removing any residual liquid from the surface of the photoreceptor as may have been transferred thereto by the donor member. In operation, the device of the present invention enables ionic conduction charging of a photoconductive imaging member, or any dielectric member placed in contact therewith, by placing an ionically conductive liquid component in contact with the surface of the photoconductive imaging member and applying a voltage to the ionically conductive liquid component such that ions are transferred across the liquid/dielectric interface. The dielectric thus becomes charged by the flow of ions through the liquid component rather than by the spraying of ions across a gaseous media as occurs in a typical corotron or like corona generating device.

It is, therefore, apparent that there has been provided, in accordance with the present invention, an ionically conductive liquid charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An apparatus for applying an electrical charge to a member to be charged, comprising:

a donor member positioned in contact with the member to be charged for placing an ionically conductive liquid in contact therewith, said donor member including a hydrophilic material layer containing the ionically conductive liquid;

a pair of elastomeric blade elements, each situated on opposite sides of said hydrophilic material layer for preventing escape of the ionically conductive liquid along elongated sides of said donor member; and a pair of hydrophobic end segments each situated at opposite ends of said pair of elastomeric blade elements and interposed therebetween for preventing escape of the ionically conductive liquid from said hydrophilic material layer along opposed ends of said donor member; and means for applying an electrical bias to said ionically conductive liquid for inducing transport of ions therethrough to the member to be charged.

2. The apparatus of claim 1, wherein said hydrophilic material layer and said pair of hydrophobic end segments are fabricated from materials having substantially equivalent mechanical and physical properties.

3. The apparatus of claim 2, wherein the materials making up said hydrophilic material layer and said pair of hydrophobic end segments are crosslinked gels.

4. The apparatus of claim 3, wherein the material making up said hydrophilic material layer is a polyacrylamide and the material making up said pair of hydrophobic end segments is silicone rubber.

5. The apparatus of claim 1, wherein said pair of elastomeric blade elements include a hydrophobic material.

6. The apparatus of claim 1, wherein said hydrophobic material is selected from the group of VITON®, a copolymer of vinylidene fluoride/hexafluoropropylene, terpolymers of vinylidene fluoride/hexafluoropropylene, polybutadiene and silicone elastomers.

7. The apparatus of claim 1, wherein said ionically conductive liquid is selected from the group of distilled water, deionized water, and polyhydroxyethylmethacrylate, polyacrylates, polyvinylpyrrolidinone.

8. The apparatus of claim 7, wherein said ionically conductive liquid includes water having an ionically conductive component added thereto, said ionically conductive component being selected from the group of atmospheric carbon dioxide ($CO_2$), lithium carbonate, sodium carbonate, potassium carbonate, sodium bicarbonate, polyhydroxyethylmethacrylate, and sodium hydroxide.

9. The apparatus of claim 1, further including a conductive housing for supporting said donor member, said electrical bias applying means being coupled directly to said conductive housing for applying the electrical bias to said donor member.

10. The apparatus of claim 9, wherein said housing is fabricated from a conductive material selected from the group of brass, stainless steel, and a polymer composite loaded with conductive particles.

11. The apparatus of claim 1, further including a support blade situated in abutment with said donor member for urging said donor member against the member to be charged.

12. The apparatus of claim 1, further including a wiper blade for removing any amount of ionically conductive liquid from the member to be charged.

13. The apparatus of claim 1, wherein the member to be charged includes a photoconductive imaging member.

14. The apparatus of claim 1, wherein said means for applying an electrical bias to said ionically conductive liquid includes a DC voltage power supply.

15. An electrostatographic printing apparatus including an apparatus for applying an electrical charge to a photoreceptive member, comprising:

a donor member positioned in contact with the member to be charged for placing an ionically conductive liquid in contact therewith, said donor member including a hydrophilic material layer containing the ionically conductive liquid;

a pair of elastomeric blade elements, each situated on opposite sides of said hydrophilic material layer for preventing escape of the ionically conductive liquid along elongated sides of said donor member; and a pair of hydrophobic end segments each situated at elastometic ends of said pair of nonporous blade elements and interposed therebetween for preventing escape of the ionically conductive liquid from said hydrophilic material layer along opposed ends of said donor member; and means for applying an electrical bias to said ionically conductive liquid for inducing transport of ions therethrough to the member to be charged.

16. The apparatus of claim 15, wherein said hydrophilic material layer and said pair of hydrophobic end segments are fabricated from materials having substantially equivalent mechanical and physical properties.

17. The apparatus of claim 16, wherein the materials making up said hydrophilic material layer and said pair of hydrophobic end segments are crosslinked gels.

18. The apparatus of claim 17, wherein the material making up said hydrophilic material layer is polyacrylamide and the material making up said pair of hydrophobic end segments is silicone rubber.

19. The apparatus of claim 15, wherein said pair of elastomeric blade elements include a hydrophobic material.

20. The apparatus of claim 1, wherein said hydrophobic material is selected from the group of VITON®, a copolymer of vinylidene fluoride/hexafluoropropylene, terpolymers of vinylidene fluoride/hexafluoropropylene, polybutadiene and silicone elastomers.

21. The apparatus of claim 15, wherein said ionically conductive liquid is selected from the group of distilled water, deionized water, and polyhydroxyethylmethacrylate, polyacrylates, polyvinylpyrrolidinone.

22. The apparatus of claim 15, wherein said ionically conductive liquid includes water having an ionically conductive component added thereto, said ionically conductive component being selected from the group of atmospheric carbon dioxide ($CO_2$), lithium carbonate, sodium carbonate, potassium carbonate, sodium bicarbonate, polyhydroxyethylmethacrylate, and sodium hydroxide.

23. The electrostatographic printing apparatus of claim 15, further including a conductive housing for supporting said donor member, said electrical bias applying means being coupled directly to said conductive housing for applying the electrical bias to said donor member.

24. The electrostatographic printing apparatus of claim 23, wherein said housing is fabricated from a conductive material selected from the group of brass, stainless steel, and a polymer composite loaded with conductive particles.

25. The electrostatographic printing apparatus of claim 15, further including a support blade for urging said donor member against the photoreceptive member.

26. The electrostatographic printing apparatus of claim 15, further including a wiper blade for removing any amount of ionically conductive liquid from the photoreceptive member.

27. The electrostatographic printing apparatus of claim 15, wherein said means for applying an electrical bias to said ionically conductive liquid includes a DC voltage power supply.

* * * * *